US010697603B2

(12) United States Patent
Okubo

(10) Patent No.: US 10,697,603 B2
(45) Date of Patent: Jun. 30, 2020

(54) VEHICULAR LIGHT WITH PROJECTION LENS

(71) Applicant: ICHIKOH INDUSTRIES, LTD., Isehara-shi, Kanagawa-ken (JP)

(72) Inventor: Yasuhiro Okubo, Isehara (JP)

(73) Assignee: ICHIKOH INDUSTRIES, LTD., Isehara-Shi (JP)

( * ) Notice: Subject to any disclaimer, the term of this patent is extended or adjusted under 35 U.S.C. 154(b) by 35 days.

(21) Appl. No.: 15/569,895

(22) PCT Filed: May 13, 2016

(86) PCT No.: PCT/JP2016/064380
§ 371 (c)(1),
(2) Date: Oct. 27, 2017

(87) PCT Pub. No.: WO2016/182078
PCT Pub. Date: Nov. 17, 2016

(65) Prior Publication Data

US 2018/0106444 A1 Apr. 19, 2018

(30) Foreign Application Priority Data

May 13, 2015 (JP) ..... 2015-098572

(51) Int. Cl.
*F21S 41/255* (2018.01)
*F21S 41/00* (2018.01)
(Continued)

(52) U.S. Cl.
CPC ..... *F21S 41/255* (2018.01); *F21S 41/00* (2018.01); *F21S 41/141* (2018.01);
(Continued)

(58) Field of Classification Search
CPC .... F21S 41/25–275; F21S 41/00; F21S 43/00; F21V 19/00
(Continued)

(56) References Cited

U.S. PATENT DOCUMENTS

2008/0253141 A1* 10/2008 Nakada ..... F21S 41/147 362/507
2011/0002126 A1 1/2011 Chen et al.
(Continued)

FOREIGN PATENT DOCUMENTS

EP 2719941 A1 * 4/2014 ..... F21S 41/321
JP 2014-071958 A 4/2014
(Continued)

OTHER PUBLICATIONS

Iwasaki, Vehicle Lamp Device, 2014, Patent Pub WO2014077079A1; Google Patents, https://patents.google.com/patent/WO2014077079A1/en (Year: 2014).*
Office Action issued in corresponding Chinese Patent Application No. 201680027255.4 dated Dec. 2, 2019, with English translation.

*Primary Examiner* — Anh T Mai
*Assistant Examiner* — Michael Chiang
(74) *Attorney, Agent, or Firm* — Foley & Lardner LLP

(57) ABSTRACT

A lens of vehicular light has an entrance surface comprising: an upper part entrance surface for allowing light from the light source to enter, the light source being irradiated in an upper direction at a greater angle than a predetermined upper irradiation angle; a lower part entrance surface for allowing light from the light source to enter, the light source being irradiated in a lower direction at a greater angle than a predetermined lower irradiation angle; and a central entrance surface between the upper part entrance surface and the lower part entrance surface. The lower part entrance surface has a first lower part entrance surface on the light source optical axis side, and a second lower part entrance
(Continued)

surface below the first lower part entrance surface. The lens performs the light distribution control whereby the light entering in the second lower part entrance surface is irradiated in a lower direction.

6 Claims, 8 Drawing Sheets

(51) Int. Cl.

| | |
|---|---|
| ***F21S 43/00*** | (2018.01) |
| ***F21V 19/00*** | (2006.01) |
| ***F21S 41/143*** | (2018.01) |
| ***F21S 41/265*** | (2018.01) |
| ***F21S 41/141*** | (2018.01) |
| *F21W 102/18* | (2018.01) |

(52) U.S. Cl.
CPC ..... *F21S 41/143* (2018.01); *F21S 41/265* (2018.01); *F21S 43/00* (2018.01); *F21V 19/00* (2013.01); *F21W 2102/18* (2018.01)

(58) Field of Classification Search
USPC ..... 362/522
See application file for complete search history.

(56) References Cited

U.S. PATENT DOCUMENTS

| | | | | |
|---|---|---|---|---|
| 2013/0003402 | A1* | 1/2013 | Chao | F21S 41/255 362/520 |
| 2013/0027961 | A1* | 1/2013 | Ugajin | F21S 41/143 362/538 |
| 2013/0294102 | A1 | 11/2013 | Iwasaki | |
| 2014/0313762 | A1* | 10/2014 | Owada | B60Q 1/0088 362/538 |
| 2015/0103551 | A1 | 4/2015 | Tanaka | |
| 2015/0316224 | A1 | 11/2015 | Okubo et al. | |
| 2016/0084464 | A1* | 3/2016 | Han | G02B 1/10 362/510 |

FOREIGN PATENT DOCUMENTS

| | | | | | |
|---|---|---|---|---|---|
| JP | 2014-078463 | A | | 5/2014 | |
| JP | 2014-099281 | A | | 5/2014 | |
| JP | 2014078463 | A | * | 5/2014 | F21S 41/321 |
| JP | 2014-102984 | A | | 6/2014 | |
| JP | 2014-164876 | A | | 9/2014 | |
| JP | 2014-203587 | | | 10/2014 | |
| WO | WO-2014/080748 | A1 | | 5/2014 | |
| WO | WO-2014077079 | A1 | * | 5/2014 | F21V 5/045 |

* cited by examiner

[FIG. 1]
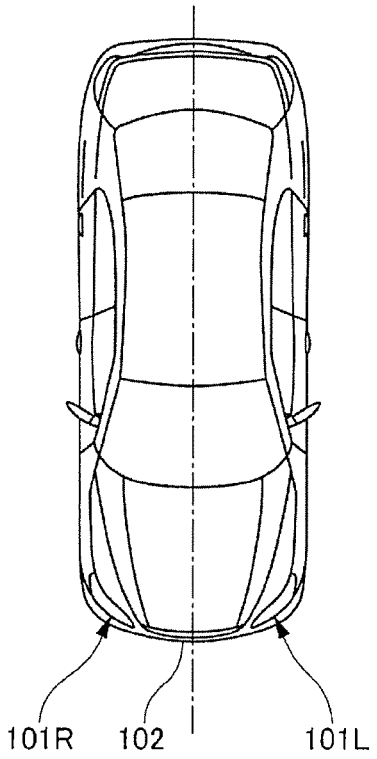
[FIG. 2]
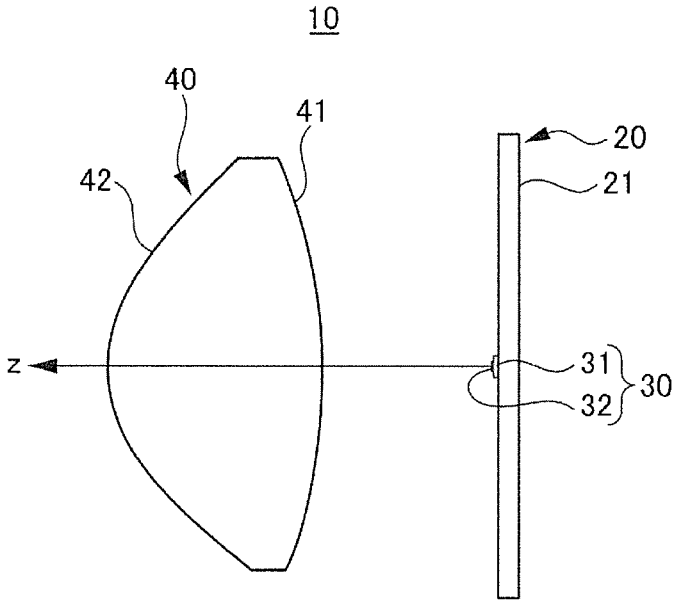

[FIG. 3]
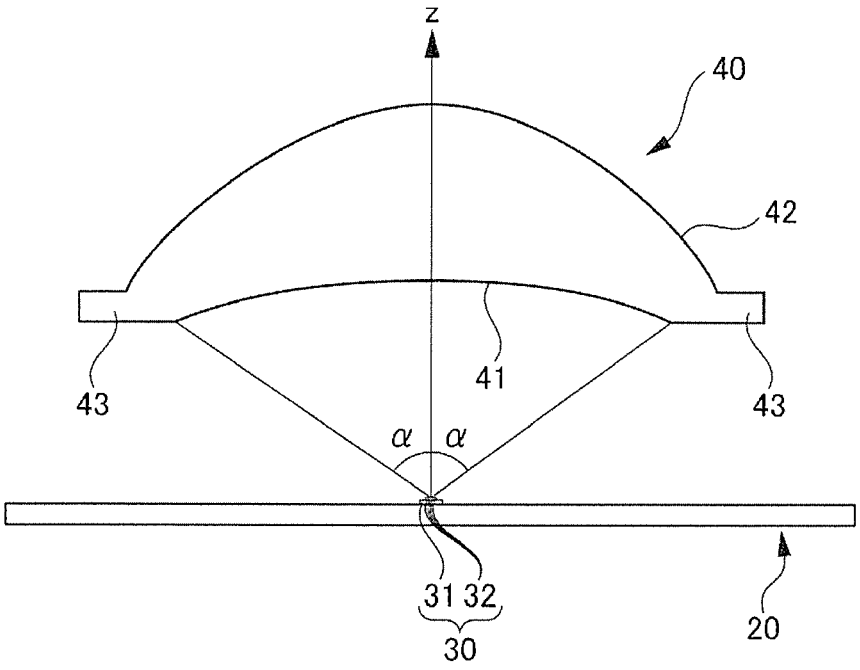
[FIG. 4]
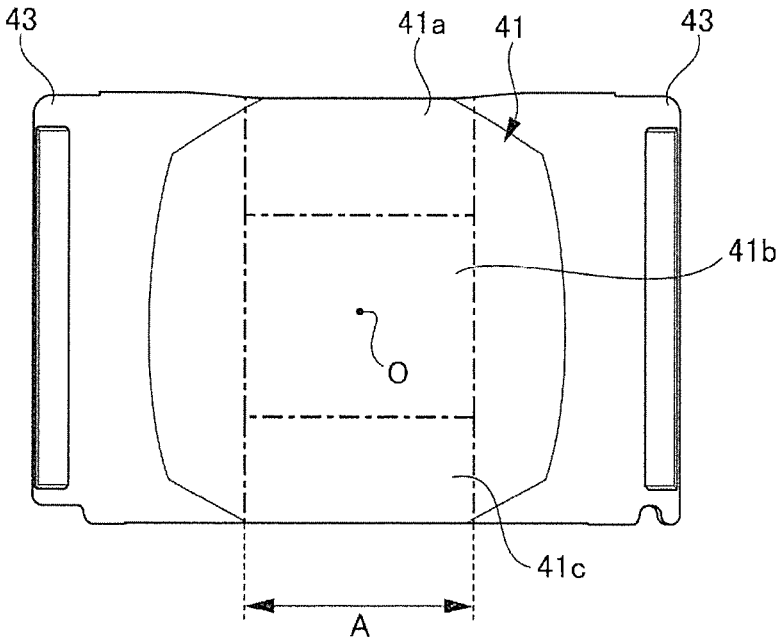

[FIG. 5]
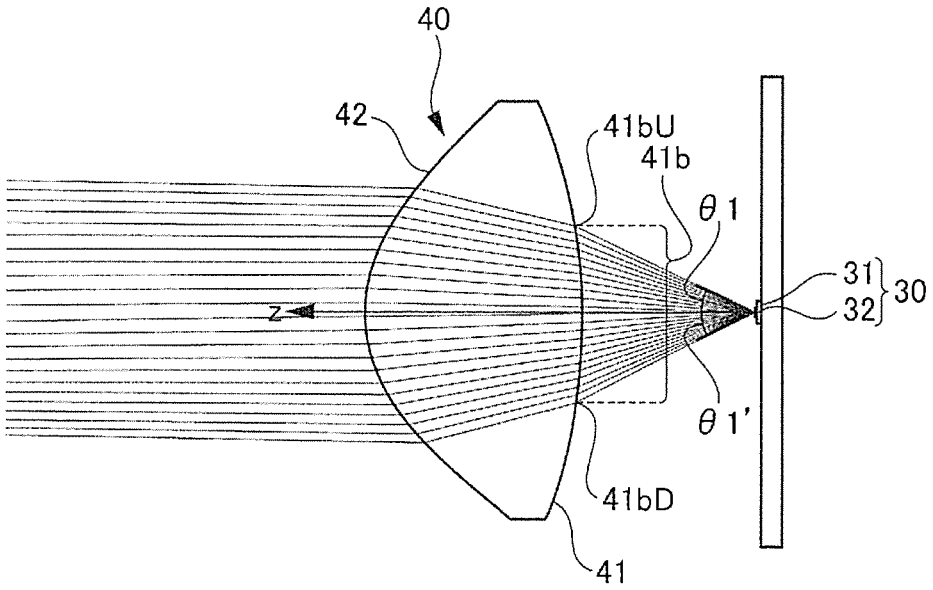
[FIG. 6]
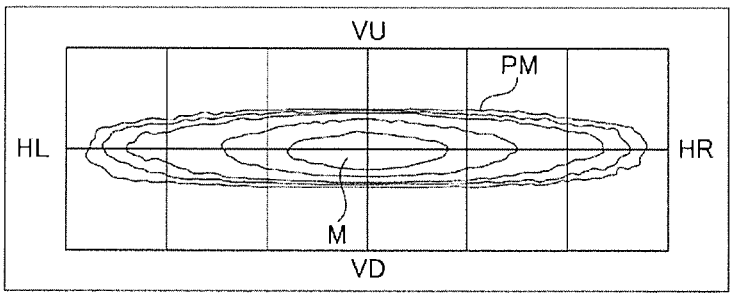
(a)
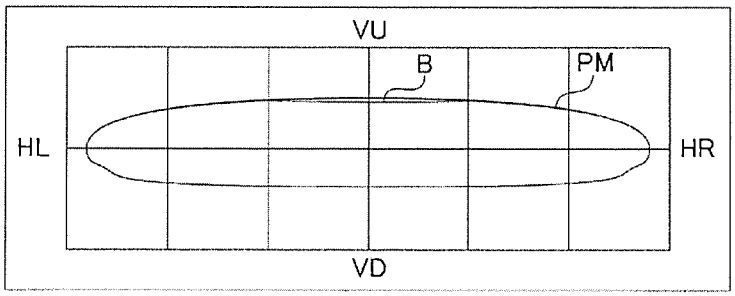
(b)

[FIG. 7]
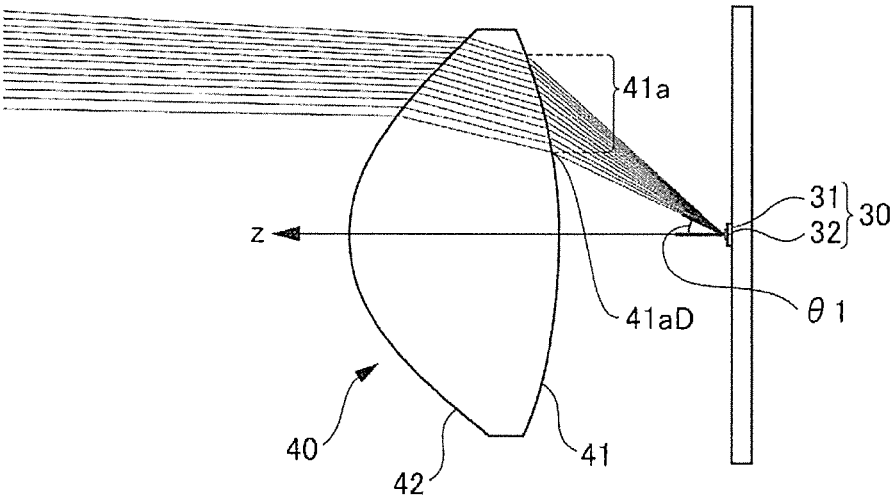
[FIG. 8]
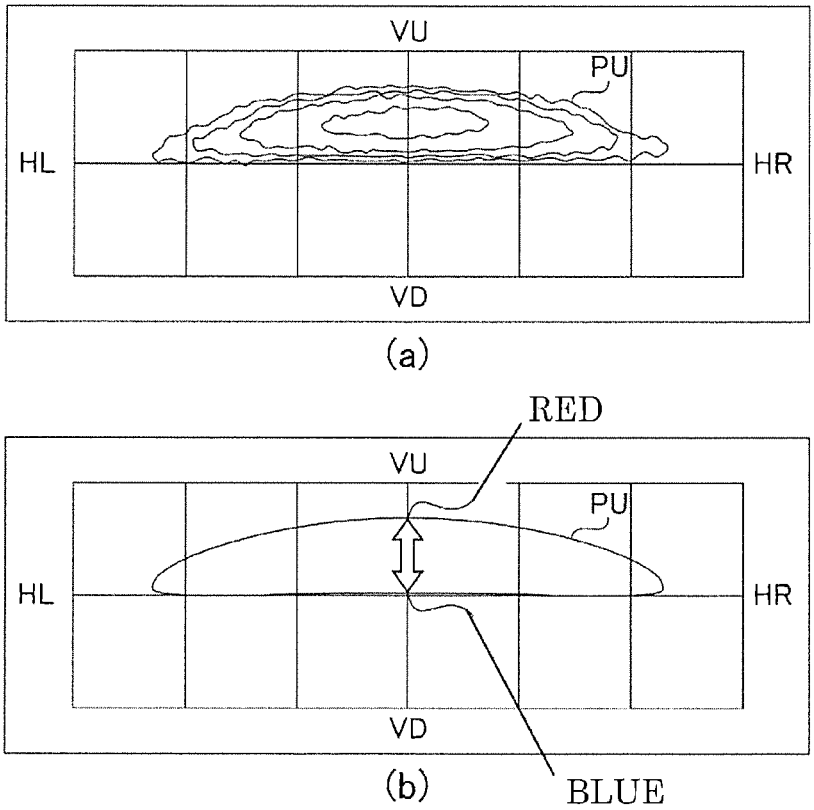

[FIG. 9]
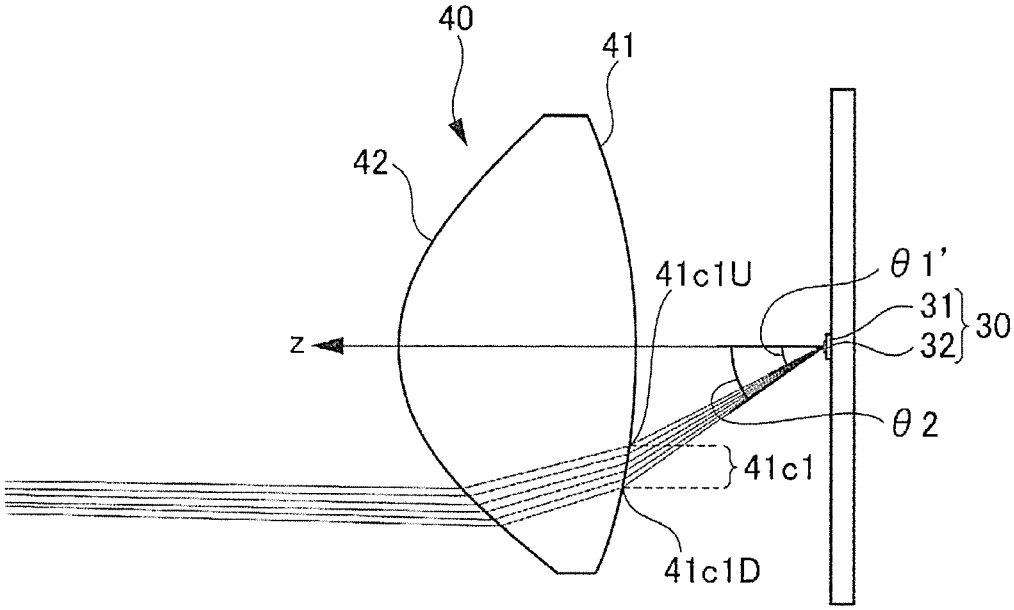
[FIG. 10]
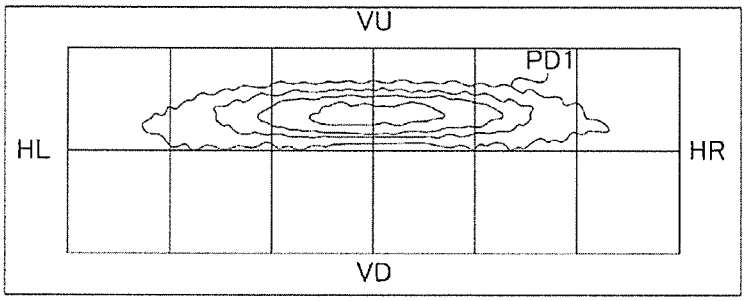
(a)
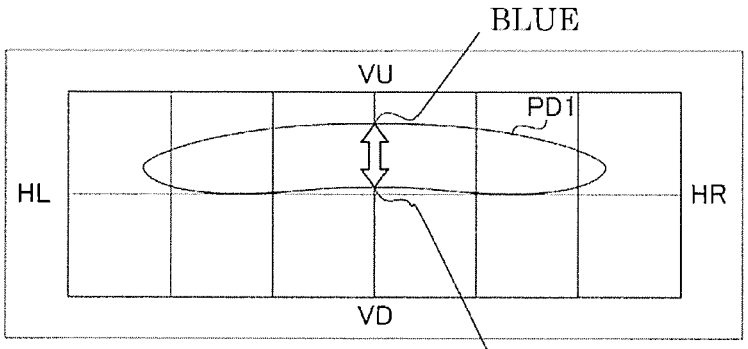
(b)

[FIG. 11]
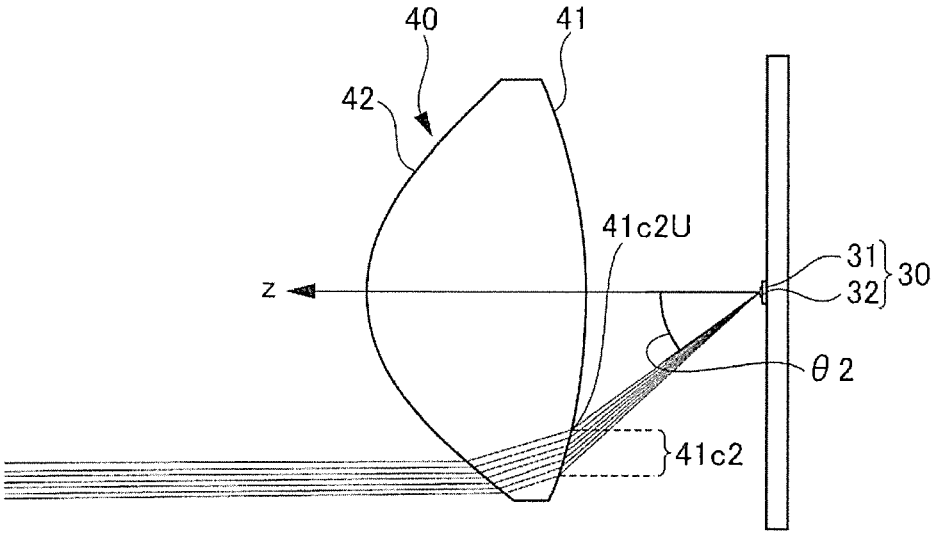
[FIG. 12]
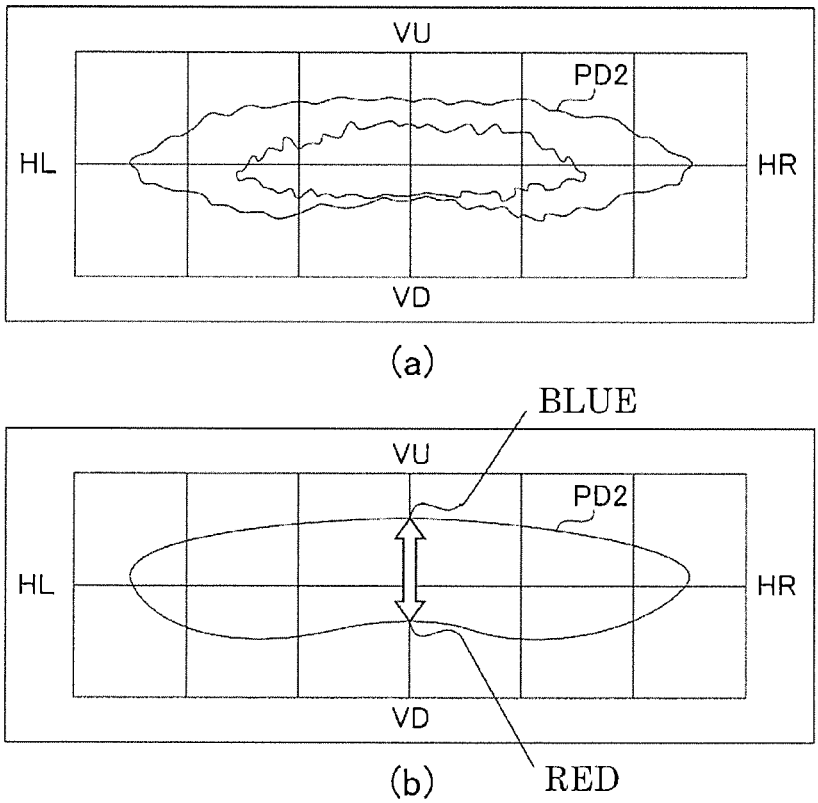

[FIG. 13]
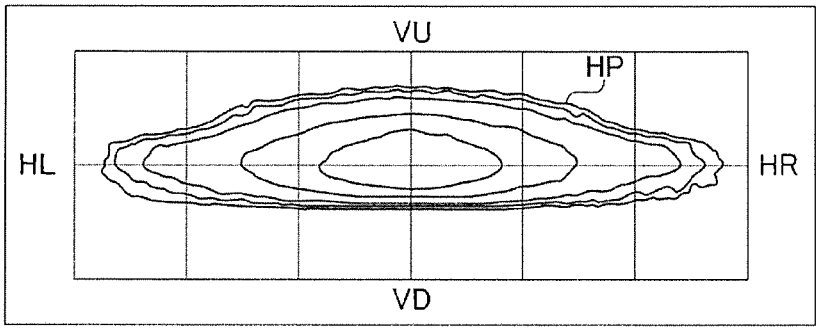
(a)
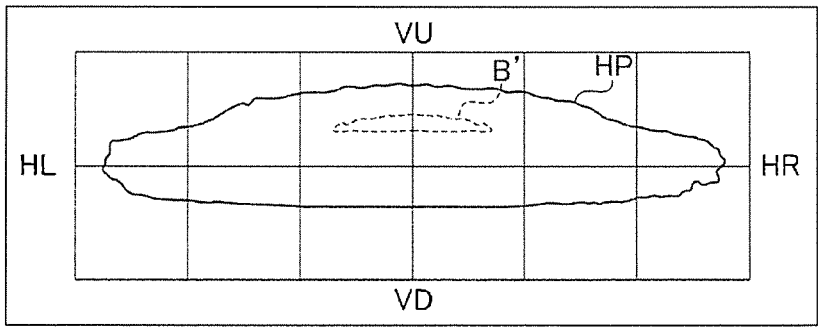
(b)

[FIG. 14]
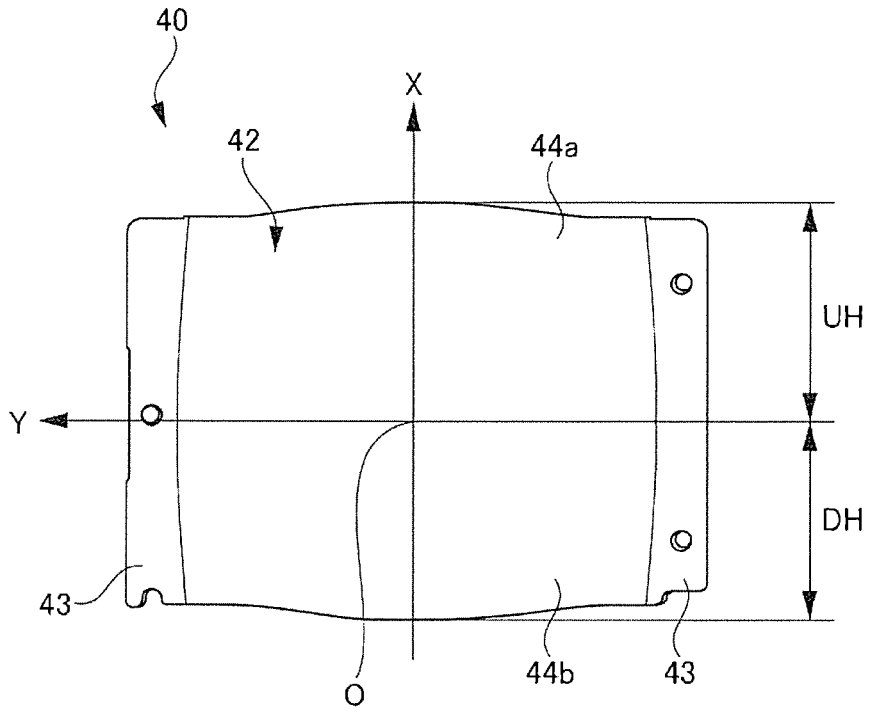

VEHICULAR LIGHT WITH PROJECTION LENS

TECHNICAL FIELD

The present invention relates to a vehicular light.

BACKGROUND ART

Conventionally, there is known a vehicular light to ensure that emitted light beams, which strongly disperse from a lens upper part and a lens lower part, contribute to a central intensity band (refer to Patent Literature 1).

However, in a case where a resin has been employed as a material for a lens, if a design is made in such a manner as to ensure that the emitted light beams from the lens upper part and the lens lower part contribute to the central intensity band, the thus emitted light beams are influenced due to a change of a refractive index of the lens exerted by atmospheric temperature; and therefore, there is a problem that the central intensity band varies.

On the other hand, there is also a vehicular light in which emitted light beams from a lens upper part and a lens lower part are radiated upward so as to come off of a central intensity band (refer to Patent Literature 2).

Thus, it is contemplated to ensure that the emitted light beams from the lens upper part and the lens lower part come off of the central intensity band to be thereby able to solve the problem that the central intensity band varies.

However, if the emitted light beams from the lens upper part and the lens lower part are radiated upward so as to thereby come off of the central intensity band, there is a problem that a strong blue spectral color is generated at an upper side of a light distribution pattern.

CITATION LIST

Patent Literature

Patent Literature 1; Japanese Unexamined Patent Application Publication No. 2014-102984

Patent Literature 2: Japanese Unexamined Patent Application Publication No. 2014-078463

SUMMARY OF THE INVENTION

Problems to be Solved by the Invention

The present invention has been made in view of the circumstance described above, and it is an object of the present invention to provide a vehicular light allowing variation of a central intensity band and generation of a blue spectral color to be suppressed.

Means for Solving the Problem

In order to achieve the above object, the present invention is realized by the following constitution.

(1) A vehicular light according to the present invention comprising: a semiconductor-type light source; and a resin lens to carry out light distribution control of light from the light source, wherein the lens has an entrance surface which comprises: an upper part entrance surface intended to allow entry of light from the light source radiated upward at certain angular degrees which are greater than predetermined degrees of an upward irradiation angle, with reference to at least a light source optical axis of the light source; a lower part entrance surface intended to allow entry of light from the light source radiated downward at certain angular degrees which are greater than predetermined degrees of a lower irradiation angle; and an intermediate entrance surface between the upper part entrance surface and the lower part entrance surface, wherein the lower part entrance surface has a first lower part entrance surface at the light source optical axis side and a second lower part entrance surface which is lower than the first lower part entrance surface, wherein the lens carries out light distribution control to downward radiate light allowed to enter the second lower part entrance surface and to upward radiate light allowed to enter each of the upper part entrance surface and the first lower part entrance surface, and wherein an upward irradiation angle of the light allowed to enter the first lower part entrance surface is smaller than an upward irradiation angle of the light allowed to enter the upper part entrance surface.

(2) The vehicular light according to above (1), wherein the first lower part entrance surface and the upper part entrance surface control an upward irradiation angle with respect to light of which wavelength is 500 nm or more.

(3) The vehicular light according to above (1) or (2), wherein the lens is formed so that, with reference to a lens optical axis of the lens, an upper portion than the lens optical axis is greater in vertical width than a lower portion than the lens optical axis.

(4) The vehicular light according to above (1) to (3), wherein at least a respective one of the upper part entrance surface and the lower part entrance surface, a light dispersion structure is formed, and the light dispersion structure that is formed on the lower part entrance surface is set so as to be greater in light dispersion quantity than the light dispersion structure formed on the upper part entrance surface.

(5) The vehicular light according to above (1) to (4), wherein the light source has four or more light emitting chips, the lens has a backward focal length of 18 mm or more, and the lens is formed so that the backward focal point of the lens is positioned at or near a light emission center of a light emission surface which is formed by the light emitting chips.

Effect of the Invention

According to the present invention, there is provided a vehicular light allowing variation of a central intensity band and generation of a blue spectral color to be suppressed.

BRIEF DESCRIPTION OF THE DRAWINGS

FIG. 1 is a plan view of a vehicle provided with a vehicular light of an embodiment according to the present invention.

FIG. 2 is a vertical sectional view taken along an optical axis of a light source of a lighting unit of the embodiment according to the present invention.

FIG. 3 is a horizontal sectional view taken along the optical axis of the light source of the lighting unit of the embodiment according to the present invention.

FIG. 4 is a plan view when an entrance surface of a lens of the embodiment according to the present invention is seen.

FIG. 5 is a view for explaining light distribution control of light allowed to enter an intermediate entrance surface of the lens of the embodiment according to the present invention.

FIG. 6 is a view showing a light distribution pattern on a screen which is formed by the light allowed to enter the intermediate entrance surface of the lens of the embodiment according to the present invention, in which FIG. 6(*a*) is a view showing an iso-intensity curve of the light distribution pattern, and FIG. 6*b*) is a view showing a state of color of the light distribution pattern.

FIG. 7 is a view for explaining light distribution control of light allowed to enter an upper part entrance surface of the lens of the embodiment according to the present invention.

FIG. 8 is a view showing a light distribution pattern on a screen which is formed by the light allowed to enter the upper part entrance surface of the lens of the embodiment according to the present invention, in which FIG. 8(*a*) is a view showing an iso-intensity curve of the light distribution pattern, and FIG. 8(*b*) is a view showing a state of color of the light distribution pattern.

FIG. 9 is a view for explaining light distribution control of light allowed to enter a first lower part entrance surface of a lower part entrance surface of the lens of the embodiment according to the present invention.

FIG. 10 is a view showing a light distribution pattern on a screen which is formed by the light allowed to enter the first lower part entrance surface of the lens of the embodiment according to the present invention, in which FIG. 10(*a*) is a view showing an iso-intensity curve of the light distribution pattern, and FIG. 10(*b*) is a view showing a state of color of the light distribution pattern.

FIG. 11 is a view for explaining light distribution control of light allowed to enter a second lower part entrance surface of the lower part entrance surface of the lens of the embodiment according to the present invention.

FIG. 12 is a view showing a light distribution pattern on a screen which is formed by light allowed to enter the second lower part entrance surface of the lens of the embodiment according to the present invention, in which FIG. 12(*a*) is a view showing an iso-intensity curve of the light distribution pattern, and FIG. 12(*b*) is a view showing a state of color of the light distribution pattern.

FIG. 13 is a view showing a high beam light distribution pattern of the embodiment according to the present invention, in which FIG. 13(*a*) is a view showing an iso-intensity curve of the high beam light distribution pattern, and FIG. 13(*b*) is a view showing a state of color of the high beam light distribution pattern.

FIG. 14 is a plan view when an emission surface of the lens of the embodiment according to the present invention is seen.

MODE FOR CARRYING OUT THE INVENTION

Hereinafter, mode for carrying out the present invention (hereinafter, referred to as the "embodiment") will be described in detail with reference to the accompanying drawings. Throughout the entire description of the embodiment, the same constituent elements are designated by the same reference numerals. In addition, in the embodiment and figures, unless set forth in particular, the terms "forward" and "backward" respectively designate the "forward direction" and "backward direction" of a vehicle, and the terms "upper", "lower", "leftward" and "rightward" respectively designate the directions as seen from a driver who is riding on the vehicle.

A vehicular light according to an embodiment of the present invention is a vehicular headlamp (101R, 101L) which is provided at a respective one of the front left and right of a vehicle 102 shown in FIG. 1. Incidentally, hereinafter this light is simply referred to as a vehicular light.

The vehicular light of the embodiment is provided with: a housing (not shown) opening at a frontal side of a vehicle; and an outer lens (not shown) which is mounted to a housing so as to cover the opening, and in a lamp room which is formed of the housing and the outer lens, a lighting unit 10 (refer to FIG. 2) or the like is disposed.

FIG. 2 is a vertical sectional view taken along an optical axis Z of a light source of the lighting unit 10.

As shown in FIG. 2, the lighting unit 10 is a lighting unit of a lens direct emission type, which is provided with: a heat sink 20; a semiconductor-type light source 30 disposed in the heat sink 20; and a lens 40 mounted to the heat sink 20 via a lens holder (not shown) and allowing the light from the light source 20 to directly enter the lens 40.

(Heat Sink)

It is preferable that the heat sink 20 be a member to radiate a heat generated by the light source 30 and be molded by employing a metal material of which thermal conductivity is high (such as aluminum, for example) or a resin material.

Although, in the embodiment, a case of a heat sink 20 formed in a shape of a flat plate is shown, the shape of the heat sink 20 is arbitrary, and for example, there may be provided a heat radiation fin extending rearward to a back face 21 positioned at an opposite side of a face on which the light source 30 is to be disposed.

(Light Source)

As the light source 30, there is employed an LED in which light emitting chips 32 have been provided on a substrate 31 on which electric wires for feeding power or the like, which are not shown, have been formed.

More specifically, on the substrate 31, an LED is employed so that four light emitting chips 32 are disposed in a horizontal direction, and a light emission surface in a rectangular shape in a front view is formed.

Incidentally, the number of light emitting chips 32 provided on the substrate 31 is not limited to four, more light emitting chips 32 may be provided, and four or more light emitting chips 32 are disposed to thereby able to obtain a high quantity of light which is preferable to form a high beam light distribution pattern.

In addition, although, in the embodiment, the light emission surface is formed in the rectangular shape in the front view, the light emission surface per se may be formed in a square shape.

Further, although, in the embodiment, the LED is employed as the light source 30, the light source 30 may be a semiconductor-type light source such as an LD (a semiconductor laser).

(Lens)

The lens 40 is formed of: an acrylic resin such as PMMA; or a transparent resin material such as polycarbonate (PC) or polycyclohexylene dimethylene terephthalate (PCT), for example.

In general, a refractive index of a material is expressed as the one that has been measured by a sodium D-ray (a wavelength: 589 nm); and however, even with a same kind of material, if the measurement wavelength is different, the refractive index is also different.

In addition, if wavelength dependency of the refractive index (variation of the refractive index exerted by a wavelength) is great, dispersion is prone to readily take place; and however, an acrylic resin such as MMA is a material of which wavelength dependency of refractive index is comparatively small and thus dispersion is prone to be small.

Therefore, it is preferable, in particular, that the lens 40 be formed of an acrylic resin such as MMA among the materials described above.

An entrance surface 41 intended to allow entry of the light from the lens 40, when it is seen in a vertical sectional view, as shown in FIG. 2, is formed so as to be a convex curved surface on the light source 30 side.

On the other hand, FIG. 3 shows a horizontal sectional view taken along an optical axis Z of a light source of the lighting unit 10; and however, in the horizontal sectional view, the entrance surface 41 is a curved surface formed in a shape concaving inward.

Incidentally, in FIG. 3, which is similar to FIG. 2, a lens holder is not shown.

Thus, the entrance surface 41 of the lens 40 is formed in a composite quadrature curved surface of which vertical sectional view is a convex curved surface and of which horizontal sectional view is a concave curved surface.

When a portion of the concave curved surface of the entrance surface 41 is described more specifically, as shown in FIG. 3, this portion is formed in such a manner that, with reference to the optical axis Z of the light source, a range of entry of the light from the light source 30 that is radiated forward, in which a horizontal irradiation angle $\alpha$ (the irradiation angle in the horizontal direction) is within a predetermined angle, is formed in the curved surface concaving inward.

In the embodiment, the predetermined angle is set to 25 degrees and thus the curved surface concaving inward is formed with respect to the range of the entry of the light from the light source 30 that is radiated forward, in which the horizontal irradiation angle is within 25 degrees with reference to the optical axis Z of the light source (a transverse front side in a horizontal direction with reference to the optical axis Z of the light source).

However, this angle does not need to be limitative to 25 degrees, and may be varied as required, and for example, it is preferable that certain angular degrees equivalent to degrees of the predetermined horizontal irradiation angle $\alpha$ be selected from the range of 20 degrees or more and 30 degrees or less.

Incidentally, in the embodiment, the lens 40 is disposed so that a lens optical axis of the lens 40 and the light axis Z of the light source are coincident with each other; and therefore, FIG. 3 is also a horizontal sectional view obtained by cutting the lighting unit 10 in the horizontal direction at the position of the lens optical axis of the lens 40.

On the other hand, as shown in FIG. 2 and FIG. 3, even if the emission surface 42 from which the light of the lens 40 is to be emitted is seen in a vertical sectional view or in a horizontal sectional view, this surface is formed in convex manner to the front side, and is formed as a free curved surface so that a predetermined light distribution pattern is obtained according to the shape of the entrance surface 41.

As described above, the light source 30 having four or more light emitting chips 32 is preferably employed; and however, in a case where so many light emitting chips 32 are present, the quantity of a heat increases.

If so, there is an apprehension that the resin lens 40 is degraded due to influence of such a heat.

Accordingly, it is preferable that the lens 40 have a backward focal length of 18 mm or more.

The lens 40 is disposed so that a backward focal point of the lens 40 is positioned at or near a light emission center of the light emission surface that is formed by the light emitting chips 32; and however, the backward focal length of the lens 40 is thus set to 18 mm or more, and the lens 40 can be thereby disposed so as to keep a sufficient distance from the light source 30 to be thus able to avoid degradation of the resin lens 40 due to the influence of the heat.

FIG. 4 is a plan view when the lens 40 is seen from a back side so as to view the entrance surface 41 of the lens 40.

Hereinafter, a description will be furnished with respect to a light distribution state in which the light beams entering the respective positions of the entrance surface 41 are formed while a central portion (refer to the range A) of the lens 40 forming a main light distribution, as indicated by the single-dotted chain line in FIG. 4, is divided into an upper part entrance surface 41*a*, an intermediate entrance surface 41*b*, and a lower part entrance surface 41*c*.

FIG. 5 is a vertical sectional view taken along the optical axis Z of the light source, and shows a state of light distribution control of the light allowed to enter the intermediate entrance surface 41*b*.

In so far as the intermediate entrance surface 41*b* is concerned, as shown in FIG. 5, an upper end 41*b*U is positioned to allow the entry of the light from the light source 30 that is radiated upward at certain angular degrees equivalent to degrees of a predetermined upward irradiation angle $\theta$1 and a lower end 41*b*D is located at a position at which the light from the light source 30 that is radiated downward at certain angular degrees equivalent to degrees of a predetermined lower irradiation angle $\theta$1'.

More specifically, the intermediate entrance surface 41*b* is an entrance surface 41 intended to allow entry of the light from the light source 30 within the range from the position at which the predetermined upward irradiation angle $\theta$1 is 25 degrees to the position at which the predetermined lower irradiation angle $\theta$1' is 25 degrees, namely, at a small irradiation angle which is within the range of the irradiation angle of 25 degrees with reference to the optical axis Z of the light source.

In so far as the light allowed to enter the intermediate entrance surface 41*b* is concerned, the light at a small irradiation angle of the light from the light source 30 is allowed to enter; and therefore, in comparison with the upper part entrance surface 41*a* or the lower part entrance surface 41*c* intended to allow entry of the light at a great irradiation angle of the light from the light source 30, the light thus allowed to enter is radiated forward from the emission surface 42 of the lens 40 without great flexion (refraction); and hence, this light is less influenced by spectra in comparison with the light allowed to enter the upper part entrance surface 41*a* or the lower part entrance surface 41*c*.

In addition, the fact that the light is radiated forward without great flexion (refraction) means that, even if the refractive index of the lens 40 is varied due to a temperature change, the light distribution pattern is less influenced.

Thus, while the range of the entry of the light that is emitted (radiated forward) without a great flexion (refraction) is the intermediate entrance surface 41*b*, as shown in FIG. 6, a main light distribution pattern PM of a high beam light distribution pattern HP is formed by the light allowed to enter the intermediate entrance surface 41*b*.

FIG. 6 is a view showing the light distribution pattern PM on the screen that is formed by the light allowed to enter the intermediate entrance surface 41*b*, in which the line VU-VD designates the vertical line, and the line HL-HR designates the horizontal line.

Incidentally, in other figures that follow as well, the line VU designates the vertical line, and the line HL-HR designates the horizontal line.

FIG. 6(*a*) is a view showing the light distribution pattern PM on the screen by iso-intensity curve, of which luminous intensity is higher towards a more central side, and FIG. 6(*b*) is a view showing a state of color of the light distribution pattern PM on the screen.

Incidentally, as described above, the central portion (refer to range A of FIG. 4) of the lens 40 that forms the main light distribution is shown here and thus an actual light distribution pattern PM is somewhat broader in the transverse direction than the state shown in FIG. 6.

Hereinafter, the views of the light distribution patterns shown in other figures each are similar to that of FIG. 6, and the actual light distribution patterns are somewhat broader than in the transverse direction than those which are illustrated.

As shown in FIG. 6(*a*), it is found that the light allowed to enter the intermediate entrance surface 41*b* forms the main light distribution pattern of the high beam light distribution pattern having a high luminous intensity in the central intensity band M (the central portion at which the horizontal line and the vertical line cross each other).

On the other hand, as shown in FIG. 6(*b*), the light allowed to enter the intermediate entrance surface 41*b* is prone to hardly disperse and thus this light entirely forms a white light distribution pattern PM; and however, this situation does not mean that the light thus allowed to enter is completely influenced by spectra, and a blue spectral color B is prone to partially appear in the vicinity of an upper center of the light distribution pattern PM.

Accordingly, in a state of the high beam light distribution pattern HP obtained by multiplexing the light distribution patterns formed by the light allowed to enter the upper part entrance surface 41*a* and the lower part entrance surface 41*c*, it follows that a blue spectral color B (refer to FIG. 6(*b*) which appears at an upper side of the light distribution pattern PM formed by the intermediate entrance surface 41*b* is suppressed.

Hereinafter, the upper part entrance surface 41*a* and the lower part entrance surface 41*c* will be described in sequential order.

FIG. 7 is a vertical sectional view taken along the optical axis Z of the light source, and shows a state of light distribution control of the light allowed to enter the upper part entrance surface 41*a*.

In so far as the upper part entrance surface 41*a* is concerned, as shown in FIG. 7, a lower end 41*a*D is positioned to allow the entry of the light from the light source 30 that is radiated upward at certain angular degrees equivalent to degrees of the predetermined upward irradiation angle θ1 with reference to the optical axis Z of the light source.

More precisely, the upper part entrance surface 41*a* is an upper part entrance surface that follows the intermediate entrance surface 41*b*; and therefore, this surface is also an entrance surface 41 for the entry of the light from the light source 30 that is radiated upward at the predetermined angle which is greater than the upward irradiation angle θ1, and in the embodiment, the upper part entrance surface 41*a* is an entrance surface 41 for the entry of the light from the light source 30, of which predetermined upward irradiation angle θ1 is greater than 25 degrees.

As shown in FIG. 7, light distribution control is carried out in such a manner that the light allowed to enter the upper part entrance surface 41*a* is radiated upward when it is emitted from the lens 40, namely, when it is radiated forward.

FIG. 8 shows a light distribution pattern PU which is formed by the light allowed to enter the upper part entrance surface 41*a*, of which light distribution has been thus controlled.

FIG. 8 is a view showing the light distribution pattern PU on the screen which is formed by the light having been allowed to enter the upper part entrance surface 41*a*, in which FIG. 8(*a*) is a view showing the light distribution pattern PU on the screen by the iso-intensity curve, and shows that the luminous intensity is higher towards a more central side, and FIG. 8(*b*) is a view showing a state of color of the light distribution pattern PU on the screen.

As shown in FIG. 7, light distribution control is carried out in such a manner that the light thus allowed to enter the upper part entrance surface 41*a* is radiated upward from an upper portion of the emission surface 42 of the lens 40, and as shown in FIG. 8(*a*), the light distribution pattern PU that is formed by the light allowed to enter the upper part entrance surface 41*a* is characterized in that a portion of a high luminous intensity is formed at an upper side which comes off of the central intensity band (the central portion at which the horizontal line and the vertical line cross each other).

Although briefly set forth in the description of the intermediate entrance surface 41*b*, the light of which upward irradiation angle from the light source 30 is great is allowed to enter the upper part entrance surface 41*a*, and the light thus allowed to enter is radiated forward from the emission surface 42 of the lens 40 while having a great flexion (refraction).

Thus, in a case where the light is radiated forward together with great flexion (refraction), if the refractive index of the lens 40 varies due to a temperature change, the position of the thus formed light distribution pattern PU is prone to readily vary while it is influenced by the variation of the refractive index.

However, as described above, the portion of the high luminous intensity is positioned at the upper side at which the light distribution pattern PU that is formed by the light allowed to enter the upper part entrance surface 41*a* comes off of the central intensity band (the central portion at which the horizontal line and the vertical line cross each other); and therefore, even if the refractive index of the lens 40 varies, the central intensity band (the central portion at which the horizontal line and the vertical line cross each other) can be less influenced.

On the other hand, the light allowed to enter the upper part entrance surface 41*a* and then radiated forward from the upper side of the emission surface 42 of the lens 40, as indicated by the two-way arrow in FIG. 8(*b*), is characterized in that a blue spectral color appears at the lower side of the light distribution pattern PU and a red spectral color appears to be stronger towards the upper side.

As described previously, the light distribution pattern PM that is formed by the light allowed to enter the intermediate entrance surface 41*b* is characterized in that the blue spectral color appears at the upper side of the light distribution pattern PM (refer to FIG. 6(*b*); and therefore, the light distribution pattern PU that is formed by the light allowed to enter the upper part entrance surface 41*a* shown in FIG. 8(*b*) is multiplexed, and the blue spectral color and the red spectral color are thereby mixed with each other and then are whitened.

Next, the lower part entrance surface 41*c* will be described.

The lower part entrance surface 41*c* is an entrance surface 41 for the entry of the light from the light source 30 that is radiated downward at certain angular degrees which are greater than predetermined degrees of the lower irradiation angle θ1' (refer to FIG. 5), specifically at certain angular degrees of which lower irradiation angle θ1' is greater than 25 degrees; and however, as described later, the lower part entrance surface 41*c* has: a first lower part entrance surface 41*c*1 at the optical axis Z side of the light source and a second lower part entrance surface 41*c*2 which is lower than the first lower part entrance surface 41*c*1.

Hereinafter, with reference to FIG. 9 to FIG. 12, the first lower part entrance surface 41*c*1 and the second lower part entrance surface 41*c*2 will be described.

FIG. 9 is a vertical sectional view taken along the optical axis Z of the light source, and shows a state of light distribution control of the light allowed to enter the first lower part entrance surface 41*a*1 of the lower part entrance surface 41*c*.

As shown in FIG. 9, in so far as the lower part entrance surface 41*c*1 is concerned, an upper end 41*c*1U is positioned to allow the entry of the light from the light source 30 that is radiated downward at certain angular degrees equivalent to degrees of the predetermined lower irradiation angle θ1' with reference to the optical axis Z of the light source, and a lower end 41*c*1D is positioned to allow the entry of the light from the light source 30 that is radiated downward at certain angular degrees equivalent to degrees of a predetermined lower irradiation angle θ2.

More precisely, the lower part entrance surface 41*c*1 is a first lower part entrance surface which follows the intermediate entrance surface 41*b*; and therefore, the first entrance surface 41*c*1 is an entrance surface 41 for the entry of the light from the light source 30 within the range in which the predetermined lower irradiation angle θ1' is greater than 25 degrees and the predetermined lower irradiation angle θ2 is 35 degrees or less, namely, within the range in which the lower irradiation angle radiated downward is greater than 25 degrees and is 35 degrees or less with reference to the optical axis Z of the light source.

Light distribution control is carried out in such a manner that the light allowed to enter the first lower part entrance surface 41*c*1, as shown in FIG. 9 is radiated upward when it is emitted from the lens 40; and however, light distribution control is also carried out so that the upward irradiation angle when the light allowed to enter the first lower part entrance surface 41*c*1 is to be emitted from the lens 40 is smaller than an upper irradiation angle when the light allowed to enter the upper part entrance surface 41*a* described above is emitted from the lens 40.

Here, as described above, the refractive index of the lens 40 is different depending on the wavelength of light; and therefore, the refractive angle of light when the light is allowed to enter the first lower part entrance surface 41*c*1 and the upper part entrance surface 41*a* or when the light is emitted from the emission surface 2 is different dependent on the wavelength.

Thus, control of an irradiation angle in emitting light to an upper side of the first lower part entrance surface 41*c*1 and the upper part entrance surface 41*a* is designed to be carried out with reference to the light of which wavelength is 50 nm or more, more specifically, with reference to the light of which wavelength is 500 nm to 650 nm.

Incidentally, the light of the reference wavelength (the light of 500 nm to 600 nm) means the light of wavelength from F-ray to C-ray.

Namely, in so far as the first lower part entrance surface 41*c*1 and the upper part entrance surface 41*a* are concerned, control of an upper irradiation angle is carried out with respect to the light of which wavelength is 500 nm or more, more specifically, with respect to the light of wavelength from 500 nm to 650 nm.

FIG. 10 is a view showing a light distribution pattern PD1 on a screen which is formed by the light allowed to enter the first lower part entrance surface 41*c*1, in which FIG. 10(*a*) is a view showing the light distribution pattern PD1 on the screen by the iso-intensity curve, and shows that the luminous intensity is higher towards a more central side, and FIG. 10(*b*) is a view showing a state of color of the light distribution pattern PD1 on the screen.

As shown in FIG. 9, light distribution control is carried out so that the light allowed to enter the first lower part entrance surface 41*c*1 is radiated upward when it is emitted from the lens 40; and therefore, as shown in FIG. 10(*a*), the light distribution pattern PD1 that is formed by the light allowed to enter the first lower part entrance surface 41*c*1 is characterized in that a portion of a high luminous intensity is formed at an upper side which comes off of the central intensity band (the central portion at which the horizontal line and the vertical line cross each other).

Hence, as is what has been described with respect to the upper part entrance surface 41*a*, in so far as the light distribution pattern PD1 is concerned, the portion of the high luminous intensity is positioned at the upper side that comes off of the central intensity band (the central portion at which the horizontal line and the vertical line cross each other); and therefore, even if the refractive index of the lens 40 varies, the central intensity band (the central portion at which the horizontal line and the vertical line cross each other) can be less influenced.

In addition, the light distribution pattern that is formed by the light allowed to enter the lower part entrance surface 41*c* and then emitted from the lower side of the emission surface 42 of the lens 40 is characterized in that the blue spectral color appears at the upper side of the light distribution pattern, and the red spectral color appears more significantly towards the lower side as well; and however, light distribution control is carried out so that the upward irradiation angle when the light allowed to enter the first lower part entrance surface 41*c*1 is emitted from the lens 40 is smaller than the upward irradiation angle when the light allowed to enter the upper part entrance surface 41*a* described above is emitted from the lens 40; the light emitted from the lens 40 is not flexed (refracted) greatly upward, the spectral influence is mitigated; and the blue spectral color that appears at the upper side of the light distribution pattern PD1 is mitigated as well.

Thus, as shown in FIG. 10(*b*), the light distribution pattern PD1 that is formed by the light allowed to enter the first lower part entrance surface 41*c*1 is characterized in that, as indicated by the two-way arrow in FIG. 10(*b*), the blue spectral color appears at the upper side of the light distribution pattern PD1, and the red spectral color appears more significantly towards the lower side as well, whereas the blue spectral color is suppressed.

On the other hand, as described later, in so far as the light allowed to enter the second lower part entrance surface 41*c*2 is concerned, the light emitted from the lens 40 is controlled downward in light distribution.

This is because the second lower part entrance surface 41*c*2 is positioned at the lower side of the lens 40 than the first lower part entrance surface 41*c*1, and the light thus allowed to enter is strongly influenced by spectra; and therefore, upward light distribution control is disallowed.

Hereinafter, light distribution control or the like of the light allowed to enter the second lower part entrance surface 41$c$2 will be specifically described.

FIG. 11 is a vertical sectional view taken along the optical axis Z of the light source, and shows a state of light distribution control of the light allowed to enter the second lower part entrance surface 41$a$2 of the lower part entrance surface 41$c$.

As shown in FIG. 11, the second lower part entrance surface 41$c$2 is an entrance surface 41 of which upper end 41$c$2U is, with reference to the optical axis Z of the light source, located at a position intended to allow entry of the light from the light source 30 that is radiated downward at certain angular degrees equivalent to degrees of the predetermined lower irradiation angle θ2, and specifically, this surface is intended to allow entry of the light from the light source 30 that is radiated downward at certain angular degrees of which predetermined lower irradiation angle θ2 is greater than 35 degrees.

As described above, light distribution control is carried out so that the light allowed to enter the second lower part entrance surface 41$c$2 is distributed downward when it is emitted from the lens 40.

FIG. 12 is a view showing a light distribution pattern PD2 on a screen which is formed by the light allowed to enter the second lower part entrance surface 41$c$2, in which FIG. 12($a$) is a view showing the light distribution pattern PD2 on the screen by the iso-intensity curve, and shows that the luminous intensity is higher towards a more central side, and FIG. 12($b$) is a view showing a state of color of the light distribution pattern PD2 on the screen.

The second lower part entrance surface 41$c$2 is a lower entrance surface which is continuous to the first lower part entrance surface 41$c$1, and as shown in FIG. 12($a$), an upper side of the light distribution pattern PD2 that is formed by the light allowed to enter the second lower part entrance surface 41$c$2 is located at a position which is substantially the same as that of the upper side of the light distribution pattern PD1 (refer to FIG. 10($a$)) that is formed by the light allowed to enter the first lower part entrance surface 41$c$1; and however, light distribution control is carried out so that the light is distributed downward; and therefore, a lower end of the light distribution pattern PD2 that is formed by the light allowed to enter the second lower part entrance surface 41$c$2 is located at a position which is broader to the lower side than the light distribution pattern PD1 that is formed by the light allowed to enter the first lower part entrance surface 41$c$1, namely, at a position exceeding the lower end of the light distribution pattern PD1 that is formed by the light allowed to enter the first lower part entrance surface 41$c$1.

In addition, as shown in FIG. 12($a$), the iso-intensity curve is prone to hardly appear, and the light distribution pattern PD2 of which luminous intensity is entirely low is obtained.

Thus, the light distribution pattern PD2 that is formed by the light allowed to enter the second lower part entrance surface 41$c$2 is established in a light distribution state which does not entirely have a difference in luminous intensity; and therefore, even if the refractive index of the lens 40 varies, the central intensity band (the central portion at which the horizontal line and the vertical line cross each other) is less influenced.

In addition, such a light distribution pattern PD2 of which luminous intensity is low is multiplexed to be thereby able to obtain a good high beam light distribution pattern HP in which a sharp, clear contrast does not appear at a lower end of the high beam light distribution pattern.

Here, in so far as the lower part entrance surface 41$c$ is concerned, dispersion is prone to readily take place in the light radiated from a lower side of the emission surface 42 of the lens 40, and the blue spectral color strongly appears at the upper side of the light distribution pattern.

Namely, the light allowed to enter the second lower part entrance surface 41$c$2 shown in FIG. 11 is more significantly radiated forward from the lower side of the emission surface 42 of the lens 40 than the light allowed to enter the first lower part entrance surface 41$c$1 shown in FIG. 9; and therefore, dispersion is prone to readily take place in the light allowed to enter the second lower part entrance surface 41$c$2, and the blue spectral color strongly appears at the upper side of the light distribution pattern.

Hence, when the light allowed to enter the second lower part entrance surface 41$c$2 is radiated forward from the emission surface 42 of the lens 40, if an attempt is made to carry out light distribution control for upward light distribution, a light distribution pattern PD2 is formed in such a manner that a strong blue spectral color appears at the upper side of the light distribution pattern PD2; and if a high beam light distribution pattern is formed by multiplexing such a light distribution pattern PD2 in which the strong blue spectral color appears at the upper side, a light distribution pattern in which a blue spectral color strongly appears is obtained.

Accordingly, in the embodiment, when the light allowed to enter the second lower part entrance surface 41$c$2 is radiated forward from the lens 40, the light distribution is controlled downward to thereby mitigate spectral influence, and as shown in FIG. 12($a$), the light distribution pattern PD2 is broadened downward so as to thereby broadly disperse the light and lower the luminous intensity of the light distribution pattern PD2 per se.

By doing this, as shown in FIG. 12($b$), tendency of the dispersion of the light distribution pattern PD2 that is formed by the light allowed to enter the second lower part entrance surface 41$c$2 is characterized by the fact that the red spectral color appears at the lower side and the blue spectral color appears more significantly towards the upper side; and however, a change of a weak color is suppressed to the minimal level in the light of color intensity by mitigating the situation that the blue spectral color strongly gathers at the upper side and by lowering the luminous intensity of the light distribution pattern PD2 per se.

As a result, even if the light distribution pattern PD2 that is formed by the light allowed to enter the second lower part entrance surface 41$c$2 has been multiplexed, the influence due to the blue spectral color of the light distribution pattern PD2 that is formed by the light allowed to enter the second lower part entrance surface 41$c$2 is prone to hardly appear in the high beam light distribution pattern HP.

FIG. 13 shows a state of the high beam light distribution pattern HP that is formed by multiplexing the light distribution patterns PU, PM, PD1, and PD2 that are formed by the light allowed to enter each of the entrance surfaces (the upper part entrance surface 41$a$, the intermediate entrance surface 41$b$ and the lower part entrance surface 41$c$ (the first lower part entrance surface 41$c$1 and the second lower part entrance surface 41$c$2)) in the same manner as that described above.

FIG. 13($a$) is a view showing the high beam light distribution pattern HP on the screen by the iso-intensity curve, and shows that the luminous intensity is higher towards a more central side, and FIG. 13($b$) is a view showing a state of color of the high beam light distribution pattern HP on the screen.

In so far as the high beam light distribution pattern HP shown in FIG. 13(*a*) is concerned, as described above, the central intensity band (the central portion at which the horizontal line and the vertical line cross each other) is mainly formed by the light distribution pattern PM that is formed by the light allowed to enter the intermediate entrance surface 41*b*, and the light distribution pattern PM that is formed by the light allowed to enter the intermediate entrance surface 41*b* is hardly influenced due to variation of the refractive index of the lens 40 exerted by a temperature rise.

On the other hand, as described above, the light distribution patterns PU, PD1 that are formed by the light allowed to enter the upper part entrance surface 41*a* and the first lower part entrance surface 41*c*1, and that is readily influenced due to the variation of the refractive index of the lens 40, are intended to be present at an upper side at which the portion of the high luminous intensity comes off of the central intensity band (the central portion at which the horizontal line and the vertical line cross each other) so as not to influence the central intensity band (the central portion at which the horizontal line and the vertical line cross each other), and the light distribution pattern PD2 that is formed by the light allowed to enter the second lower part entrance surface 41*c*2 is intended so as not to influence the central intensity band (the central portion at which the horizontal line and the vertical line cross each other) while it is established in a light distribution state in which a difference in luminous intensity is small.

As a result, even if the refractive index of the lens 40 varies due to a temperature rise, variation of the central intensity band (the central portion at which the horizontal line and the vertical line cross each other) of the high beam light distribution pattern HP is suppressed.

In addition, as shown in FIG. 13*b*), the blue spectral color that appears at the upper side of the light distribution pattern PM that is formed by the light allowed to enter the intermediate entrance surface 41*b* has been whitened in a state in which the high beam light distribution pattern HP has been obtained by multiplexing the light distribution patterns PU, PD1, and PD2 that are formed by the upper part entrance surface 41*a* and the lower part entrance surface 41*c* (the first lower part entrance surface 41*c*1 and the second lower part entrance surface 41*c*2).

In the meantime, even if the procedure described above is carried out, there may be a case in which a weak blue spectral color still remains at the portion indicated by the reference letter B' in FIG. 13(*b*).

Thus, in a case where such a weak blue spectral color still remains, it is further possible to eliminate such a weak blue spectral color by carrying out the procedure described below.

FIG. 14 is a front view when the emission surface 42 from which the light of the lens 40 is to be emitted is seen in a front view.

Incidentally, portions at which convex parts at the left and right of the lens 40 (one convex part at the left side of the figure and two convex parts at the right side of the figure) are formed are flanges 43 which are held by a lens holder, and the inside of each of the flanges 43 is the emission surface 42 from which the light is to be emitted.

The X-axis shown in FIG. 14 is a vertical axis passing through the lens optical axis O (the optical central axis of the lens), and the Y-axis is a horizontal axis passing through the lens optical axis O.

Incidentally, a light emission center of a light emission surface which is formed by the light emitting chips 32 of the light source 30 is positioned at or near the lens optical axis O.

As shown in FIG. 14, the lens 40 consists of; an upper portion 44*a* than the lens optical axis O with reference to the lens optical axis O; and a lower portion 44*b* than the lens optical axis O; the upper portion 44*a* is formed so that a width in a vertical direction is a width UH; and the lower portion 44*b* is formed so that a width in a vertical direction is a width DH.

Here, the fact that the light distribution pattern that is formed by the light allowed to enter the lower part entrance surface 41*c* and then is radiated forward from the emission surface 42 of the lens 40 is characterized by the fact that the blue spectral color appears at the upper side is as has been described previously.

In addition, the weak blue spectral color that arrears at the portion indicated by the reference letter B' in FIG. 13(*b*) described above, as is evident referring to FIG. 13(*b*), appears at the upper side of the high beam light distribution pattern HP, and can be thus suppressed by reducing a rate of the light that is radiated forward from the lower side of the emission surface 42 of the lens 40.

From the foregoing descriptive matters, in so far as the lens 40 is concerned, it is preferable to reduce an area of the emission surface 42 at the lower side of the lens 40 so that the upper portion 44*a* than the lens optical axis O with reference to the lens optical axis O is formed to be greater in horizontal width (width UH>width DH) than the lower portion 44*b* than the lens optical axis O.

Further, it is also preferable to provide a microstructure (a light dispersion structure) of which irregularities are continuous on the entrance surface 41 of the lens 40 so that the light beams are mixed with each other, in order to suppress the weak blue spectral color that still remains at the portion indicated by the reference letter B' in FIG. 13(*b*).

Specifically, a light dispersion structure is provided to be formed in such a shape that: a concave part concaving in a gentle curved inclinations toward a center of the concave part on each of the upper part entrance surface 41*a* and the lower part entrance surface 41*c* within the range A shown in FIG. 4; and a convex part protruding in a gentle curved inclination towards a center of the convex part are continuous to each other (in such a shape that gentle convexity and concavity are continuous to each other).

At this time, the height of irregularities in the light dispersion structure of the lower part entrance surface 41*a* is increased; the light dispersion structure that is formed on the lower part entrance surface 41 is set so as to be greater in light dispersion quantity than the light dispersion structure that is formed on the upper part entrance surface 41*a*; and the dispersion quantity of the light allowed to enter the lower part entrance surface 41*c* is increased to be thereby able to preferably suppress the weak blue spectral color that still remains at the portion indicated by the reference letter B' in FIG. 13(*b*).

In addition, when the light dispersion structure is thus provided on each of the upper part entrance surface 41*a* and the lower part entrance surface 41*c*, it is possible to attain an influence of blurring the outer circumference of each of the light distribution patterns PU, PD1, and PD2 that are formed by the light allowed to enter the upper part entrance surface 41*a* and the lower part entrance surface 41*c*; and therefore, when the light distribution patterns are multiplexed, it is possible to suppress a straight brightness line exerted by a change of the luminous intensity from appearing at the boundary of an overlap portion of the light distribution patterns.

Incidentally, the same light dispersion structure as that formed on the upper part entrance surface 41*a* may be provided on the intermediate entrance surface 41*b* within the range A shown in FIG. 4 as well.

In addition, a light dispersion structure may be provided on the entrance surface 41 outside of the range A shown in FIG. 4 (the left and right outsides) as well.

Thus, the width UH of the upper portion 44*a* is set so as to be greater than the width DH of the lower portion 44*b*; a light dispersion structure is provided on each of the upper part entrance surface 41*a* and the lower part entrance surface 41*c*; the light dispersion structure of the lower part entrance surface 41*c* is set so as to be greater in light dispersion quantity than the optical structure of the upper part entrance surface 41*a* to thereby able to obtain a high beam light distribution pattern in which a blue spectral color is prone to more hardly appear.

While the present invention has been described by way of specific embodiment, the present invention is not imitative to the embodiment described above.

The embodiment was presented with respect to a case in which, while a portion of the entrance surface 41 for the entry of the light within the range in which the upward irradiation angle θ1 of the light from the light source 30 is 25 degrees or less and the lower irradiation angle θ1' is 25 degrees or less is defined as the intermediate entrance surface 41*b*, the upper entrance surface 41 than the intermediate entrance surface 41*b* is defined as the upper part entrance surface 41*a*, and the lower entrance surface 41 than the intermediate entrance surface 41*b* is defined as the lower part entrance surface 41*c*; and however, the present invention is not limitative thereto.

As described above, it is sufficient that the intermediate entrance surface 41*b* is present in a range for the entry of the light that is hardly influenced due to the variation of the refractive index of the lens 40, and that is prone to hardly disperse; and from this point of view, it is sufficient that the upper end 41*b*U of the intermediate entrance surface 41*b* is positioned to allow the entry of the upward irradiation angle θ1 that is selected from the range in which the upward irradiation angle θ1 is 15 degrees or more and 30 degrees or less, and that the lower end 41*b*D of the intermediate entrance surface 41*b* is located at a position of the entry of the light of the lower irradiation angle θ1' that is selected from the range in which the lower irradiation angle θ1' is 15 degrees or more and 30 degrees or less.

Further, the embodiment was presented with respect to a case in which the portion of the entrance surface 41 for the entry of the light that is radiated downward from the light source 30 at certain angular degrees of which lower irradiation angle θ2 is greater than 35 degrees is defined as the second lower part entrance surface 41*c*2; and however, the present invention is not limitative thereto.

As described above, the second lower part entrance surface 41*c*2 is defined as a lower entrance surface on which dispersion is prone to readily take place, and from this point of view, it is sufficient that the portion of the entrance surface 41 for the entry of the light that is radiated downward from the light source 30 at certain angular degrees which are greater than the lower irradiation angle θ2 selected from the range of 30 degrees or less and 40 degrees of less is defined as the second lower part entrance surface 41*c*2.

Incidentally, the first lower part entrance surface 41*c*1 is specified as the entrance surface 41 of each of the intermediate entrance surface 41*b* and the second lower part entrance surface 41*a*2.

Accordingly, the present invention is not limitative to the specific embodiment, and alterations or modifications are also encompassed in the technical scope of the invention without departing from the technical idea, and such alterations or modifications are self-evident to one skilled in the art in the light of the claims appended thereto.

DESCRIPTION OF REFERENCE NUMERALS

10 Lighting unit
20 Heat sink
21 21 Back face
30 Light source
31 Substrate
32 Light emitting chip
40 Lens
41 Entrance surface
41*a* Upper part entrance surface
41*a*D Lower end
41*b* Intermediate entrance surface
41*b*D Lower end
41*b*U Upper end
41*c* Lower part entrance surface
41*c*1 First lower part entrance surface
41*c*1D Lower end
41*c*1U Upper end
41*c*2 Second lower part entrance surface
41*c*2U Upper end
42 Emission surface
43 Flange
44*a* Upper portion
44*b* Lower portion
HP High beam light distribution pattern
PU, PM, PD1, PD2 Light distribution patterns
M Central intensity band
O Lens optical axis
Z Optical axis of light source
101L, 101R Vehicular headlamps
102 Vehicle

The invention claimed is:

1. A vehicular light comprising:

a semiconductor-type light source; and a resin lens to carry out light distribution control of light from the light source, wherein the lens has an entrance surface which comprises:

an upper part entrance surface intended to allow entry of first light from the light source radiated upward at certain angular degrees which are greater than predetermined degrees of an upward irradiation angle, with reference to at least a light source optical axis of the light source;

a lower part entrance surface intended to allow entry of second light from the light source radiated downward at certain angular degrees which are greater than predetermined degrees of a lower irradiation angle; and an intermediate entrance surface between the upper part entrance surface and the lower part entrance surface, arranged to allow entry of third light from the light source radiated between the first light and the second light, wherein the lower part entrance surface has a first lower part entrance surface at the light source optical axis side and a second lower part entrance surface which is lower than the first lower part entrance surface, wherein the lens is arranged to perform light distribution control of the first light, the second light, and the third light so that a high luminance intensity portion of a light distribution pattern of the third light is formed centering around the light source optical axis, a high luminance intensity portion of a light distribution pattern of each of the first light and a first part of the second light which is allowed to enter the first lower part entrance surface is formed at an upper side in a vertical direction of a vehicle above the high luminance intensity portion of the light distribution pattern of the third light, and a lower end of the light distribution pattern of the second light which is allowed to enter the second lower part entrance surface is located at a position lower than a position of a lower end of the light distribution pattern of the first part of the second light in the vertical direction, and wherein an upward irradiation angle in the vertical direction of the light distribution pattern of the first part of the second light is smaller than an upward irradiation angle in the vertical direction of the light distribution pattern of the first light.

2. The vehicular light according to claim 1, wherein the first lower part entrance surface and the upper part entrance surface control an upward irradiation angle with respect to light of which wavelength is 500 nm or more.

3. The vehicular light according to claim 1, wherein the lens is formed so that, with reference to a lens optical axis of the lens, an upper portion of the lens that is above the lens optical axis is greater in vertical width than a lower portion of the lens that is above the lens optical axis.

4. The vehicular light according to claim 2, wherein the lens is formed so that, with reference to a lens optical axis of the lens, an upper portion of the lens that is above the lens optical axis is greater in vertical width than a lower portion of the lens that is below the lens optical axis.

5. The vehicular light according to claim 1, wherein at least a respective one of the upper part entrance surface and the lower part entrance surface, a light dispersion structure is formed, and the light dispersion structure that is formed on the lower part entrance surface is set so as to be greater in light dispersion quantity than the light dispersion structure formed on the upper part entrance surface.

6. The vehicular light according to claim 1, wherein the light source has four or more light emitting chips, the lens has a backward focal length of 18 mm or more, and the lens is formed so that the backward focal point of the lens is positioned at or near a light emission center of a light emission surface which is formed by the light emitting chips.

* * * * *